US008119891B2

(12) United States Patent
Ryan

(10) Patent No.: US 8,119,891 B2
(45) Date of Patent: Feb. 21, 2012

(54) FLEXIBLE SUPPORT MEMBER FOR MUSICAL INSTRUMENTS, FURNITURE, AND OBJECTS FABRICATED FROM WOOD AND METHOD OF MANUFACTURING THE SAME

(76) Inventor: Kevin Ryan, Westminster, CA (US)

( * ) Notice: Subject to any disclaimer, the term of this patent is extended or adjusted under 35 U.S.C. 154(b) by 279 days.

(21) Appl. No.: 12/381,668

(22) Filed: Mar. 13, 2009

(65) Prior Publication Data

US 2009/0229441 A1 Sep. 17, 2009

Related U.S. Application Data

(60) Provisional application No. 61/069,338, filed on Mar. 13, 2008.

(51) Int. Cl.
*G10D 3/00* (2006.01)

(52) U.S. Cl. ..... 84/291

(58) Field of Classification Search ..... 84/267, 84/291, 290; 297/186, 440.1; 403/219; 312/198, 312/139, 352, 239
See application file for complete search history.

(56) References Cited

U.S. PATENT DOCUMENTS 4,408,516 A * 10/1983 John ..... 84/275
4,881,441 A 11/1989 Larsen
5,469,770 A 11/1995 Taylor
6,166,308 A 12/2000 Lam
6,333,454 B1 12/2001 Griffiths
2003/0154843 A1* 8/2003 McPherson ..... 84/291

OTHER PUBLICATIONS

Luthiers Mercantile International, website Mar. 10, 2009, http://www.lmii.com/carttwo/thirdproducts.asp?NameProdHeader=Kerfing.

* cited by examiner

*Primary Examiner* — Kimberly Lockett
(74) *Attorney, Agent, or Firm* — James M. Duncan, Esq.; Klein, DeNatale, Goldner et al.

(57) ABSTRACT

A wood support member for attaching a first wood member to a wood side structure defining an interior peripheral edge, the wood support member is attachable to the peripheral edge, comprising a top, a bottom, a first end, a second end, a front face and a rear face. The wood support member can comprise a first plurality of kerfs in the front face and a second plurality of kerfs in the rear face, the plurality of kerfs each extending from the top to the bottom. The kerfs in the first plurality of kerfs can be spaced equidistant from each other and the kerfs in the second plurality of kerfs can be spaced equidistant from each other, and each kerf in the first plurality of kerfs can be spaced equidistant from each kerf in the second plurality of kerfs. The wood support member can have an uninstalled state, in which each kerf in the first plurality of kerfs is parallel to the other kerfs, and an installed state, in which each kerf in the first plurality of kerfs is not parallel to the other kerfs. The distance between the front face and the rear face has a measurement of D1 and the kerfs of the first plurality of kerfs and the kerfs of the second plurality of kerfs can extend into the wood support member by a measurement of D2, wherein D2 can be greater than half of D1.

14 Claims, 6 Drawing Sheets

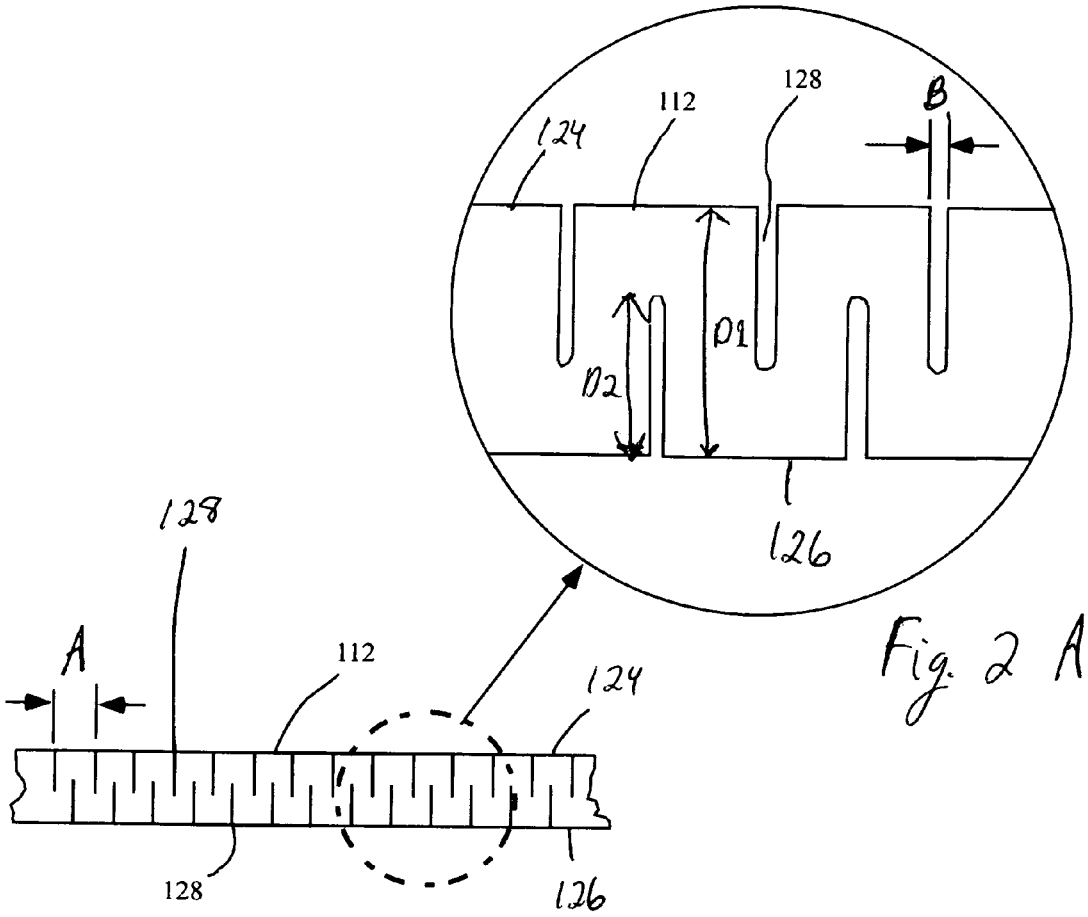
Fig. 2 A
Fig. 2
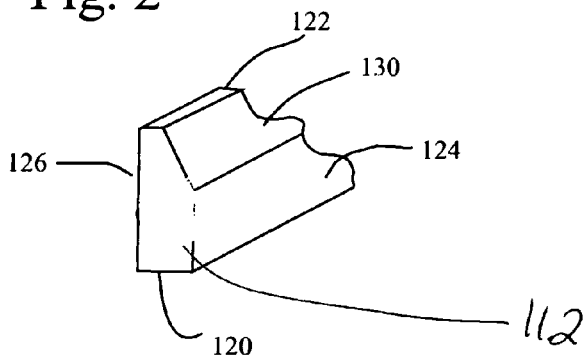
Fig. 3

FLEXIBLE SUPPORT MEMBER FOR MUSICAL INSTRUMENTS, FURNITURE, AND OBJECTS FABRICATED FROM WOOD AND METHOD OF MANUFACTURING THE SAME

CROSS-REFERENCE TO RELATED APPLICATIONS

U.S. Provisional Application No. 61/069,338 for this invention was filed on Mar. 13, 2008, for which application this inventor claims domestic priority.

BACKGROUND OF THE INVENTION

The present invention generally relates to the construction of finely crafted wooden objects, specifically musical instruments and furniture. More particularly, this invention relates to a wood support member or modified kerfing liner, which is utilized as a support surface for joining wood members together, where there is otherwise a small area available for surface contact between the wood members. This invention further relates to a method of manufacturing the kerfing.

Kerfing liner or "kerfing" is the term applied to a strip of wood that is attached, usually with glue, to the inside edge of a wood support structure where a wood face or top member or a wood back or bottom member is attached in full or partial closure of the support structure, typically when the wood support structure is fabricated of relatively thin-walled material. In the usual application, the kerfing will provide additional contact area for providing a gluing surface where a relatively strong bond between the wood members is required. When applied, this strip of wood provides a wider surface to support the face member and/or back member which is attached to the kerfing by glue or other attachment means, which is often necessary. The thickness of the wood members being joined typically range from 0.075 to 0.090 inches. The term kerfing liner is derived from the "kerfs" usually present in the kerfing liner, where the kerf is the void left after a cut of material has been taken with a saw blade, a laser cutting device or other cutting apparatus.

In one common application, kerfing liner is utilized for attaching the front and back members of a musical instrument to the sides of the instrument, such as with a guitar, mandolin, bass, or other stringed instrument utilizing a soundbox defined by side support members, a top member, and a back member. In addition, those skilled in the art of the invention will recognize applications for the modified kerfing liner for other applications, such as furniture or curio construction.

The existing kerfing has limited flexibility, requiring additional time for the artisan to build a musical instrument or other object utilizing the kerfing. For many musical instruments, furniture and other products fashioned from wood, there are many curved surfaces which often have a radius which is too tight to allow the kerfing to bend or conform to the curved surface without breaking. The known kerfing is only flexible along the axis of the kerf which is generally at a right angle to the long axis of the kerfing member. For example, if a luthier is constructing an instrument in which the back of the instrument has an arched configuration, the currently available kerfing will not bend in a manner to accommodate the compound curve—that is, the known kerfing will not have sufficient flexibility along its long axis or dimension, let alone in two axes at once. In order to resolve this problem, the kerfing must be cut into sufficiently small lengths to navigate the curves.

In addition, for those cases where the unkerfed side of the kerfing is attached to the wood member with glue, because of the unbroken "web" of wood on the back of the kerfing, there is copious glue "squeeze-out" (glue that is forced out from under the kerfing being glued under clamping pressure). This glue that has been squeezed out requires time and care to remove after the kerfing has been attached.

BRIEF DESCRIPTION OF THE DRAWINGS

FIG. 2 is a view of an embodiment of the disclosed kerfing material. Inset FIG. 2A is the detail from 2.

FIG. 3 is a perspective view of a small segment of the disclosed kerfing material, viewed from the side.

DETAILED DESCRIPTION OF THE INVENTION

Figure 1:
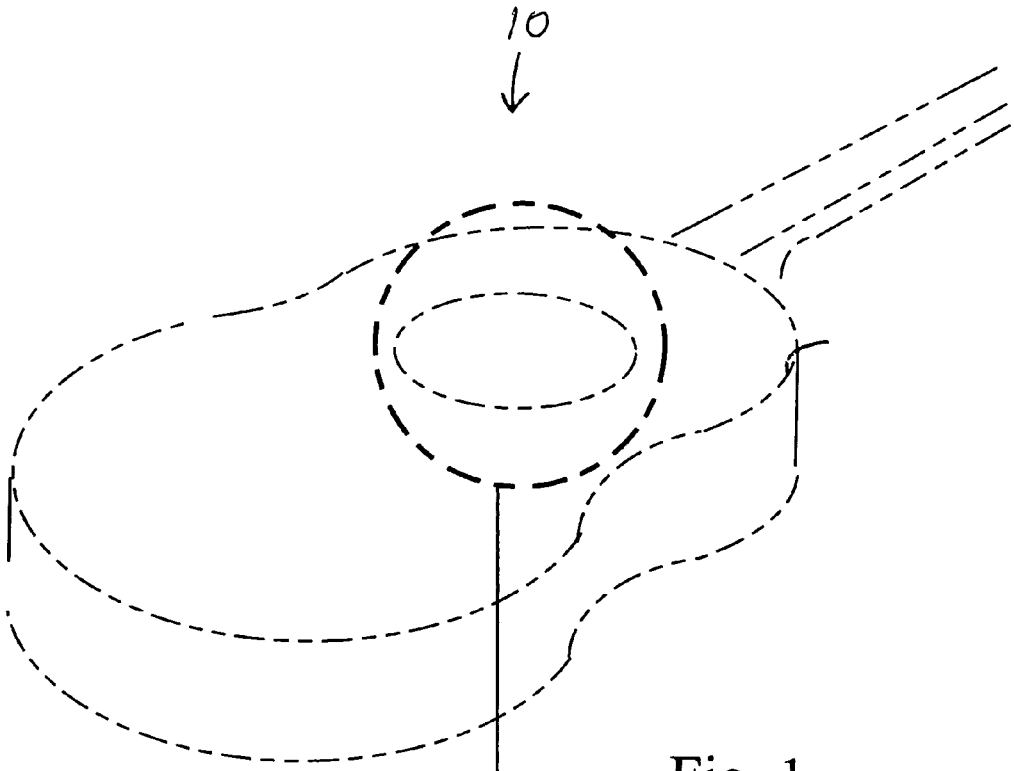
FIG. 1 is an environmental view of a prior art kerfing installation, showing the top member and the side member of a guitar. The inset 1A shows the curvature of the kerfing as the kerfing is applied to the guitar side wall and bottom member, and also around a bracing member.
Figure 1A:
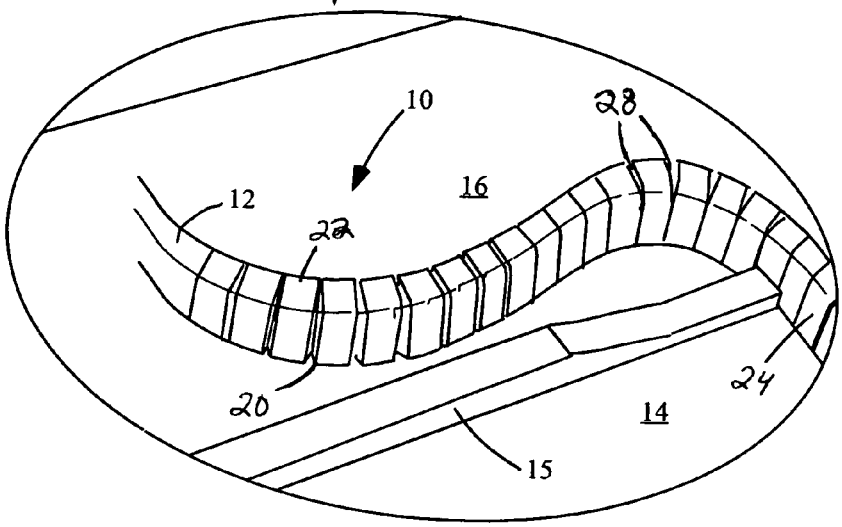

The present invention is directed to a wood support member, namely a novel variety of kerfing material, and method of manufacturing the same, which addresses the needs identified above. With reference to the Figures, FIG. 1 shows a guitar 10 having the prior art kerfing liner 12. While the known kerfing has some flexibility along an axis parallel to the kerfs 28, the kerfing 12 has very limited flexibility along an opposed axis. FIG. 5 best shows a comparison of the prior kerfing and the flexibility of the presently disclosed kerfing material along the same axis. Due to the limited flexibility, the kerfing 12 must often be cut into short lengths to navigate the curves and arches commonly found in guitars or other musical instruments, as well as finely crafted furniture. The kerfing liner 12 derives flexibility from kerfs 28 cut into the kerfing 12. The kerfs are installed by a cutting operation, by a blade, laser cutting device or other cutting apparatus. The kerfing 12 has a top 20 that is glued, adhered or otherwise attached to the first wood member 14, and a bottom 22 that can be visible inside the interior of the guitar. The front face 24 is shown as the exterior facing surface, and is the side of the kerfing 12 that has been kerfed. The prior art kerfing 12 must be cut substantially through the front face 24 to provide sufficient flexibility for installation. This cutting makes the kerfing 12 more "brittle" or prone to breakage while adhering the kerfing 12 to the curves of the wood side structure 16. Finely crafted guitars must be well constructed, as the strings impose a substantial load on the structure and yet the guitar must also avoid excess dampening and coupling which can impact the sound quality. The rear face 26 is glued, adhered or otherwise attached to the wood side structure 16. Brace members 15 are also commonly used in musical instrument construction to strengthen or stiffen the instrument, and the kerfing 12 abuts the brace members 15 in several locations. Commonly used types of woods for forming kerfing are mahogany, basswood and cypress, although the kerfing may also be the same type of wood used in the guitar, and could therefore be spruce or cedar. As differing woods are often used for the tonewood and the soundboard, the range of woods used for kerfing may also vary widely.

Diagrammatic examples of an embodiment of the disclosed kerfing are shown in FIGS. 2 and 3. The kerfs 128 can be equidistant in dimension A along the front face and can also be equidistant along the rear face 126. The kerfs 128 along the front face 124 can be offset from the kerfs 126 along the rear face 126, and the offset amount can vary based upon the luthier's needs. As can be seen in the inset FIG. 2A, the kerfs 128 can extend a length D2, which may be more than half of the depth D1 of the wood support member, although this can be altered to accommodate differing flexibilities inherent in differing woods. Width B may be 0.005 inches, but may be altered as required for flexibility. FIG. 3 shows an small segment of kerfing to which the first wood member 114 and the side member 116 would attach. The rear face 126 is the "back" of the wood support member, which is attached to the inside edge 118 of a wood support structure, such as the wood side structure 116. Because of the additional kerfs 128 made to its structure, the disclosed wood support member is extremely flexible. This flexibility can be adjusted by adjusting the distance A between the laser cuts applied to create the kerfs. Even very tight curves, such as on the cutaway section of a guitar, can easily be traversed with the disclosed wood support member without requiring the sectioning of the wood support member 112 into smaller lengths to navigate the curves. The disclosed wood support member can bend in all three axes at once, such that it can bend in very tight, compound curves. For example, with the building of a typical guitar, there is no part of the instrument for which the disclosed kerfing will not easily bend around in one continuous piece. This allows the luthier to construct the guitar without needing to pause and cut the kerfing to fit the angles of the guitar. This feature results in a substantial savings in labor and the skill necessary to install the kerfing.

Figure 6:
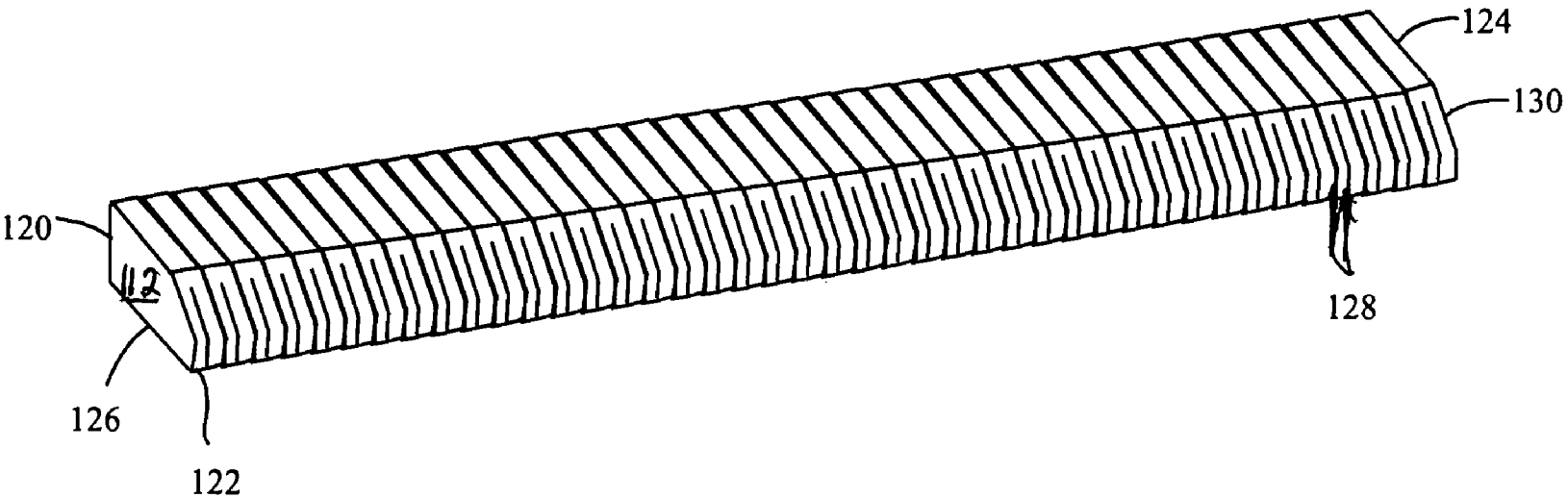
FIG. 6 is a perspective view of an embodiment of the kerfing material in an uninstalled state.

As an additional advantage, because the disclosed wood support member 112 is kerfed on both the front face 124 and the rear face 126, there is almost no glue squeeze-out, because the glue has a void into which it will squeeze when the liner is clamped, rather than being driven out from under the liner where it would be visible. As illustrated in FIG. 6, the wood support member is an uninstalled state (i.e., prior to attachment to the interior peripheral edge of the wooden instrument side), in which each kerf 128 in the first plurality of kerfs is generally parallel to the other kerfs 128. The wood support member also has an installed state (i.e., after the wood support member is attached to the interior peripheral edge of the wooden instrument side) in which each kerf 128 in the first plurality of kerfs is not necessarily parallel to the other kerfs 128. The direction and degree of rotation is of course dependant upon the two members to be attached, and the provision of a proper gluing surface.

Figure 4A:
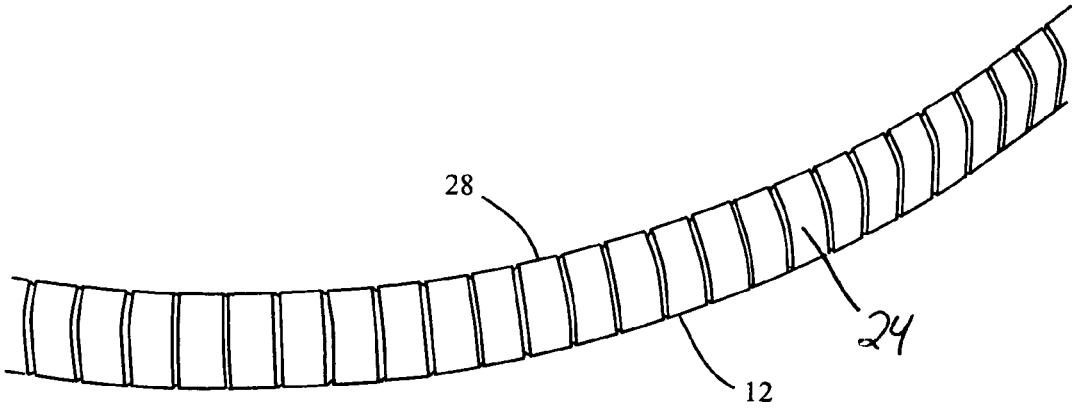
FIG. 4A shows the prior art kerfing and FIG. 4B shows an embodiment of the presently disclosed kerfing material.
Figure 4B:
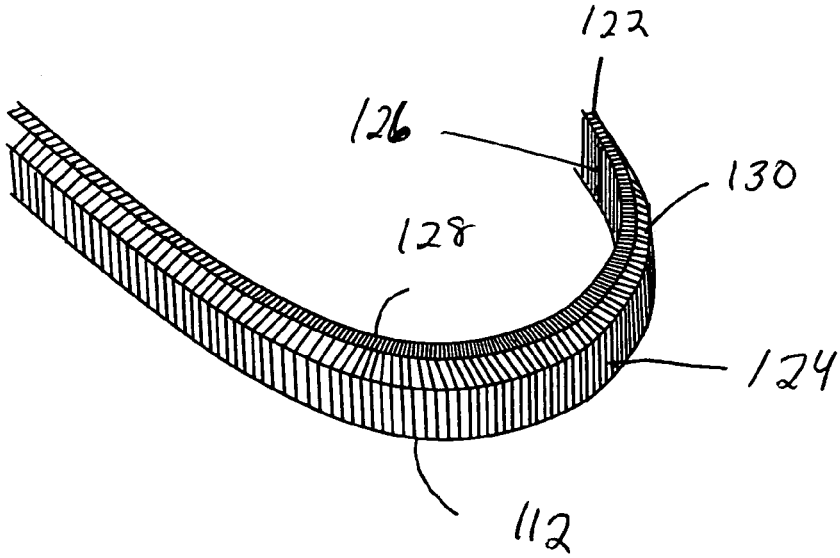

With reference to FIG. 4A, a prior art kerfing 12 is shown. The kerfs 28 are disposed along the front face 24 and provide the flexibility for the kerfing 12. FIG. 4B shows an embodiment of the presently disclosed wood support member 112, illustrating the increased flexibility of the presently disclosed kerfing. A chamfer 130 may be placed in the wood support member 112 for a visually appealing effect and for reduced weight. The wood support member can be placed in a tight radius curve with no appreciable loss of strength or gluing space, as the increased flexibility of the wood support member 112 does not require cutting the wood support member 112 to place it into close contact with the gluing surface.

Figure 5A:
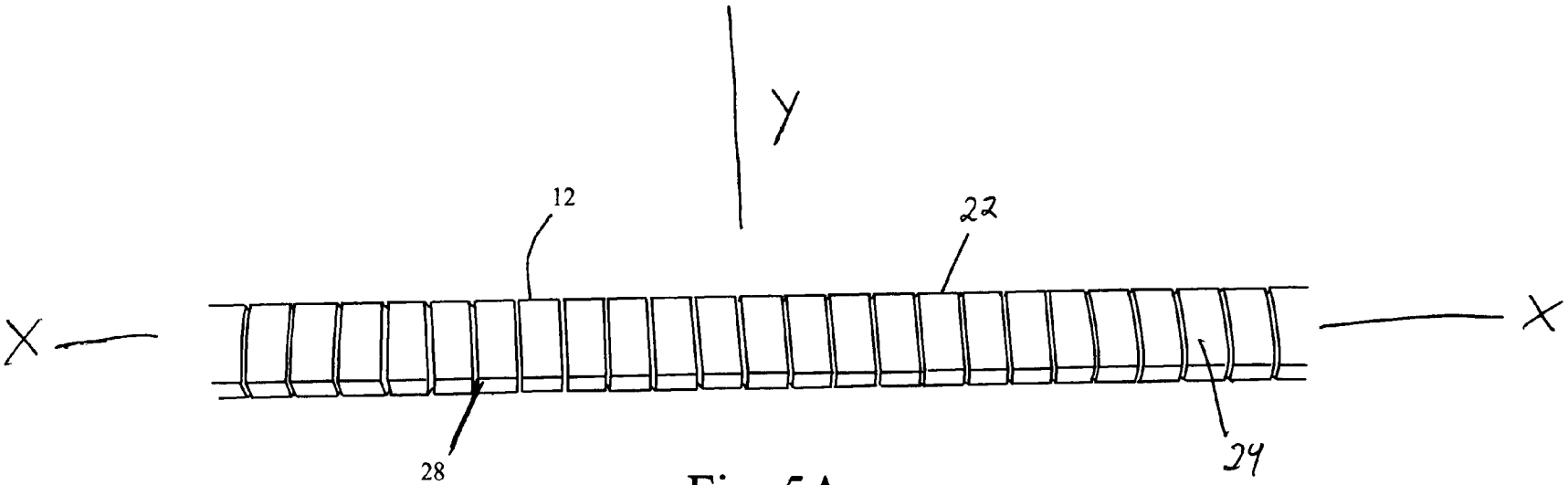
FIG. 5A is shows the prior art kerfing, indicating its lack of flexibility along axis X.
Figure 5B:
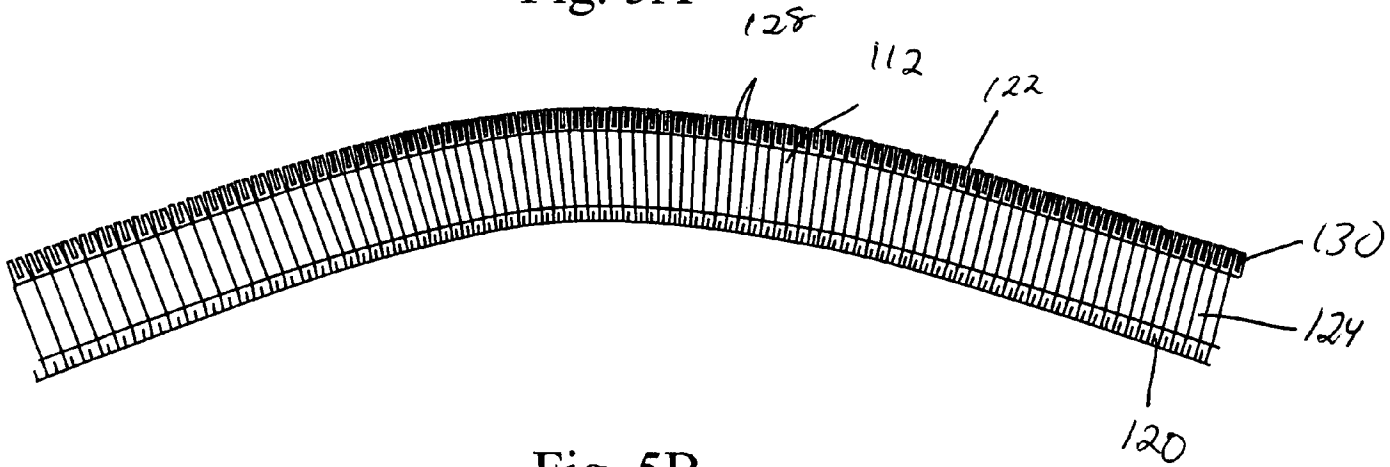
FIG. 5B shows an embodiment of the disclosed kerfing material showing the increased flexibility along the same axis.

FIG. 5A shows the prior art kerfing 12, indicating its lack of flexibility relative to the vertical axis. The kerfs 28 traverse the kerfing 12 from the top 20 to the bottom 22 along the front face 24, but do not provide sufficient flexibility in the horizontal or vertical direction to obviate the need to cut the kerfing 12 into smaller lengths. FIG. 5B shows an embodiment of the disclosed wood support member 112, indicating its flexibility along the same axes. The wood utilized for the wood support member 112 may be chosen both for aesthetic reasons, such as to match the wood used to construct the musical instrument and for mechanical reasons based upon strength. The kerfs 128 traverse the wood support member 112 from the top 120 to the bottom 122 along the front face 124 and along the rear face 126, thereby increasing the flexibility along the vertical axis and horizontal axis, even allowing the wood support member 112 to be partially twisted.

FIG. 6 shows a view of an embodiment of the disclosed wood support member, showing the bottom 122 and the chamfer 130. The flexibility of the disclosed kerfing 112 is useful for attaching a curved top member, such as the curved or arched panels frequently used in guitar construction. The flexibility also reduces the number wood support members 112 required for a guitar or similar musical instrument, whereas prior art kerfing liners could require up to 12 individually cut and placed kerfing members to be used to provide adequate surface area for joining the panels to the sides. The front face 124 faces into the interior of the musical instrument or other constructed item, and the rear face 126 is adhered to the side of the constructed item. The bottom side 120 and the chamfer 130 may provide an aesthetically pleasing look to the interior of the constructed item. The kerfs 128 of the front face 124 are offset from the kerfs 128 of the rear face 126. The kerfs 128 may also be equidistant along both the front face 124 and the rear face 126.

Figure 7:
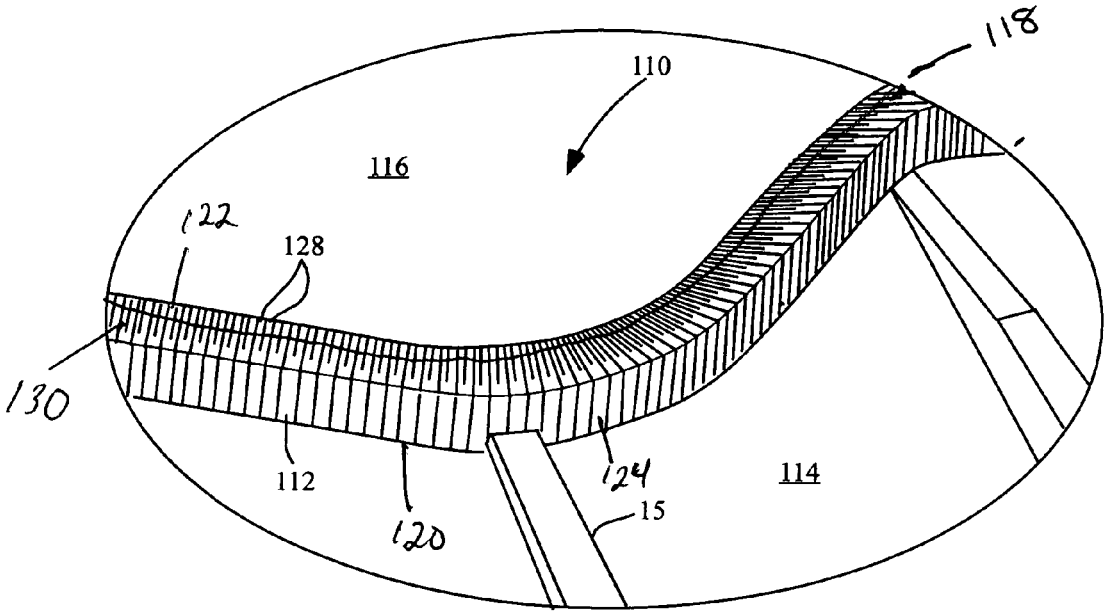
FIG. 7 is an installed view of an embodiment of the disclosed wood support member, showing the top member, side member, and bracing members.

FIG. 7 shows a perspective view of an installation 110 of an embodiment of the disclosed wood support member 112, and gives an overall view. The kerfs 128 traverse the wood support member from the top 120 to the bottom 122 along both the first and rear faces, 124 and 126. The offset arraignment of the kerfs 128 can be seen in this Figure. Optional chamfer 130 at the junction of the bottom 122 and the front face 124, if installed with a laser beam, will result in a darkening of the wood in this area due to the heat generated by the laser cutting device, thereby creating an aesthetically pleasing appearance.

The disclosed method of forming a wood support member comprises cutting the wood and form kerfs in both sides of the wood support member, or liner strip. This method of cutting the kerfs creates flexibility that is not known with the prior art wood support members. Each kerf is controlled for approximate depth of cut. FIG. 2A best shows the relative placement and dimensions of the kerfs with respect to one another. The kerfing can be cut with a laser cutting device. The method comprises anchoring a length of wood into a retention device, where the retention device may comprise a guide, a vise, a chock, a clamp, or other known retention device. The length of wood is then cut, thus forming kerfs in the wood.

Additionally, there can be a chamfer 130 or angle cut may be created, most easily with a laser. The use of the laser for cutting the chamfer causes the chamfer to be darkened from the heat of the laser beam. The dark "racing stripe" chamfer provides an attractive and distinctive appearance which sets it apart visually from other kerfing or wood support members, thus adding to the aesthetic appeal of the wood support member.

While the above is a description of various embodiments of the present invention, further modifications may be employed without departing from the spirit and scope of the present invention. Thus the scope of the invention should not be limited according to these factors, but according to the annexed claims.

What is claimed is:

1. A wood support member for attaching a first wood member to a wood side structure, the wood side structure defining an interior peripheral edge, wherein the wood support member is attachable to the interior peripheral edge, the wood support member comprising:

a top, a bottom, a first end, a second end, a front face and a rear face, wherein the wood support member comprises a first plurality of kerfs in the front face and a second plurality of kerfs in the rear face, the first plurality of kerfs and the second plurality of kerfs each extending from the top to the bottom wherein the kerfs in the first plurality of kerfs are spaced equidistant from each other and the kerfs in the second plurality of kerfs are spaced equidistant from each other and each kerf in the first plurality of kerfs is spaced equidistant from each kerf in the second plurality of kerfs.

2. The wood support member of claim 1 wherein the wood support member has an uninstalled state, prior to attachment to the interior peripheral edge, in which each kerf in the first plurality of kerfs is parallel to the other kerfs, and an installed state, after attachment to the interior peripheral edge, in which each kerf in the first plurality of kerfs is not parallel to the other kerfs.

3. The wood support member of claim 1 further comprising a chamfered top.

4. The wood support member of claim 1 wherein the distance between the front face and the rear face has a measurement of D1 and the kerfs of the first plurality of kerfs extend into the wood support member by a measurement of D2, wherein D2 is greater than half of D1.

5. The wood support member of claim 1 wherein the distance between the front face and the rear face has a measurement of D1 and the kerfs of the second plurality of kerfs extend into the wood support member by a measurement of D2, wherein D2 is greater than half of D1.

6. The wood support member of claim 1 wherein the distance between the front face and the rear face has a measurement of D1 and the kerfs of the first plurality of kerfs and the kerfs of the second plurality of kerfs extend into the wood support member by a measurement of D2, wherein D2 is greater than half of D1.

7. A wood support member for attaching a first wood member to a wood side structure, the wood side structure defining an interior peripheral edge, wherein the wood support member is attachable to the interior peripheral edge, the wood support member comprising:

a top, a bottom, a front face, a rear face, and a first plurality of kerfs traversing the front face from the top side to the bottom side and extending partially there-through and a second plurality of kerfs traversing the rear face from the top side to the bottom side and extending partially there-through, wherein the distance between the front face and the rear face has a measurement of D1 and the kerfs of the first plurality of kerfs extend into the wood support member by a measurement of D2, wherein D2 is greater than half of D1.

8. The wood support member of claim 7 wherein the kerfs on the front face are offset from the kerfs on the rear face.

9. The wood support member of claim 7 wherein the kerfs in the first plurality of kerfs are spaced equidistant from each other and the kerfs in the second plurality of kerfs are spaced equidistant from each other.

10. The wood support member of claim 7 further comprising a chamfer along a junction of the bottom and one of the faces.

11. The wood support member of claim 7 wherein the kerfs of the second plurality of kerfs extend into the wood support member by a measurement of D2.

12. A method of forming a wood support member for attaching a first wood member to a wood side structure, the wood side structure defining an interior peripheral edge, wherein the wood support member is attachable to the interior peripheral edge, the method of forming the wood support member comprising:

anchoring a length of wood into a retention device;

using a cutting device to install a plurality of parallel cuts into a front face of the wood;

using a cutting device to install a plurality of parallel cuts into a second face of the wood; and removing the kerfed wood from the retention device.

13. The method of forming a wood support member of claim 12 wherein the cuts penetrate more than halfway through the wood support member.

14. The method of forming a wood support member of claim 7 wherein the plurality of cuts are spaced equidistant from each other.

* * * * *